US006669036B1

(12) United States Patent
Yang et al.

(10) Patent No.: US 6,669,036 B1
(45) Date of Patent: Dec. 30, 2003

(54) MODULAR STORAGE ASSEMBLY

(76) Inventors: Frank Yang, 4171 Pascal Pl., Palos Verdes Peninsula, CA (US) 90061; John Duval, 3808 Hathaway Ave., #830, Long Beach, CA (US) 90815; Darren Saravis, 254 Corona Ave., Long Beach, CA (US) 90803; William Tan, 414 E. Stocker St., Glendale, CA (US) 91207

( * ) Notice: Subject to any disclaimer, the term of this patent is extended or adjusted under 35 U.S.C. 154(b) by 0 days.

(21) Appl. No.: 09/417,505

(22) Filed: Oct. 13, 1999

(51) Int. Cl.[7] ..... A47F 5/14

(52) U.S. Cl. ..... 211/181.1; 446/112; D21/488; 43/174

(58) Field of Search ..... 211/181.1, 182, 211/126.9, 133.2, 133.5; 280/79.3; 248/188.8, 188.9, 346.1; 312/334.7, 334.8; 24/336; 446/112, 114, 111; D8/382; D21/488; 403/173, 174

(56) References Cited

U.S. PATENT DOCUMENTS 548,182 A * 10/1895 Condict ..... 403/254
1,281,856 A * 10/1918 Shaw ..... 446/112
2,610,856 A * 9/1952 Welty ..... 273/160
3,006,673 A * 10/1961 Swick ..... 287/87
3,417,505 A * 12/1968 Schultz ..... 446/112
3,715,136 A * 2/1973 Yoshida ..... 287/189.36 D
3,744,646 A * 7/1973 Duncan et al. ..... 211/162
3,784,026 A * 1/1974 Grosse ..... 211/181.1
3,827,177 A * 8/1974 Wengel ..... 446/112
3,834,549 A * 9/1974 Burg et al. ..... 211/148
3,891,335 A * 6/1975 Feil ..... 403/173
3,908,562 A * 9/1975 Wittschen ..... 108/14
3,913,289 A * 10/1975 Recker ..... 52/285
3,955,510 A * 5/1976 Kinik et al. ..... 108/192
3,961,453 A * 6/1976 Couwenbergs ..... 52/509
4,124,958 A * 11/1978 Chiche ..... 52/285
D277,727 S * 2/1985 Klaric ..... D8/382
4,497,125 A * 2/1985 Hutchinson ..... 40/10 R
4,509,805 A * 4/1985 Welsch et al. ..... 312/210
4,515,280 A * 5/1985 Sheu ..... 211/189
4,571,200 A * 2/1986 Serna ..... 446/111
4,588,096 A * 5/1986 Story et al. ..... 211/126
4,765,495 A * 8/1988 Bisk ..... 211/113
4,793,725 A * 12/1988 Cheng ..... 403/174
4,913,302 A * 4/1990 Stonier ..... 220/6
4,915,462 A * 4/1990 Le Marchand et al. ..... 312/250
5,121,526 A * 6/1992 Burkard et al. ..... 24/336
5,407,084 A * 4/1995 Remmers ..... 211/183
5,503,492 A * 4/1996 Stevens et al. ..... 403/297
5,671,852 A * 9/1997 Maharg ..... 211/189
5,715,956 A * 2/1998 Yoshida ..... 211/182
5,738,226 A * 4/1998 Dean ..... 211/41.17
5,909,809 A * 6/1999 Franklin ..... 206/525
5,934,639 A * 8/1999 Chiang et al. ..... 248/346.11
6,035,514 A * 3/2000 Dean ..... 29/453
6,088,877 A * 7/2000 Swy et al. ..... 16/42 T

* cited by examiner

*Primary Examiner*—Daniel P. Stodola
*Assistant Examiner*—Khoa Tran

(57) ABSTRACT

A storage assembly has a plurality of panels that are assembled to form a plurality of storage spaces, a plurality of connectors for coupling adjacent panels to form the plurality of storage spaces, and at least one tray positioned inside one of the storage spaces. Each connector has a generally circular body having a plurality of spaced-apart scalloped regions, with a recess provided at each of the locations of the scalloped regions. The storage system includes a caster having a wheel and a caster frame. The caster frame has a body, a bore provided therethrough for receiving the wheel, and at least two spaced-apart passages formed in the circumference of the body.

16 Claims, 10 Drawing Sheets

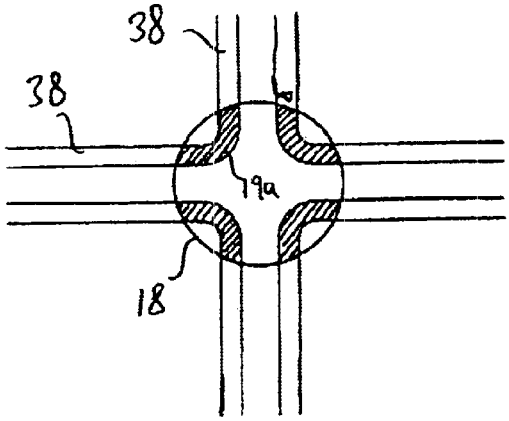
FIG. 5C
(PRIOR ART)
FIG. 5D
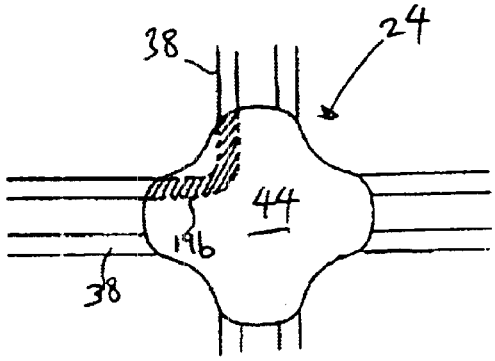

MODULAR STORAGE ASSEMBLY

BACKGROUND OF THE INVENTION

1. Field of the Invention

The present invention relates to storage assemblies that are used to store a wide variety of objects. In particular, the present invention relates to a modular storage assembly that can be assembled by a user to the desired shape and size, that allows its trays to be removed and repositioned, and that is simple in construction.

2. Description of the Prior Art

Portable storage assemblies are very popular today because they provide the user with much flexibility and convenience in use. For example, many of these conventional storage assemblies are usually provided in the form of a plurality of grated panels that have crossing bars. These panels can be connected together to form a plurality of cubic or rectangular storage spaces (hereinafter referred to as "storage units"). These panels can be assembled in any desired manner to form storage units of different sizes to fit the rooms or locations where these assemblies are to be used. In addition, some of these conventional storage assemblies are provided with wheels or casters that allow them to be quickly and conveniently moved from one location to another. Further flexibility and convenience is provided in that these conventional storage assemblies can be disassembled for (a) reconstruction into a different configuration, or (b) re-location to different locations.

Unfortunately, most of these presently-available storage assemblies suffer from a number of drawbacks. As a first example, the connections that are used to connect adjacent panels to form the storage units may be weak, so that the stability of the storage assembly is compromised. This will prevent the user from forming a large storage assembly, since the weak joints will be unable to support a large assembly that will presumably be quite heavy from storing a large number of objects and items. Second, some of the connectors used to connect adjacent panels to form the storage units have a complex structure or are difficult to install and to remove. Third, the casters are not always securely fitted at the bottom of these conventional storage assemblies, so that the casters often fall off when the storage assembly is pushed or slightly shifted from its original position. These loose casters pose a serious stability problem because the storage assembly would tilt, and depending on what is stored inside the respective storage units, may even cause the storage assembly to collapse.

As a result, there remains a need for a portable storage assembly that is easy and convenient to assemble, use, disassemble, and transport, and which is stable enough to support a large number of storage units and heavy objects inside these storage units.

SUMMARY OF THE DISCLOSURE

In order to accomplish the objects of the present invention, there is provided a storage assembly, a plurality of panels that are assembled to form a plurality of storage spaces, a plurality of connectors for coupling adjacent panels to form the plurality of storage spaces, and at least one tray positioned inside one of the storage spaces.

In one embodiment of the present invention, each connector has a generally circular body having a plurality of spaced-apart scalloped regions, with a recess provided at each of the locations of the scalloped regions.

In another embodiment of the present invention, the storage system includes a caster having a wheel and a caster frame. The caster frame can have a body, a bore provided therethrough for receiving the wheel, and at least two spaced-apart passages formed in the circumference of the body.

In yet another embodiment of the present invention, the storage system includes a pair of tracks, each track having a body that has a first end and an opposing second end, and a horizontal groove for receiving one side edge of the tray. Each track further includes a first attachment mechanism and a second attachment mechanism spaced-apart from the first attachment mechanism, with each of the first and second attachment mechanisms receiving a separate bar of a panel. The first attachment mechanism is positioned on the body at a first distance from the first end, and with the second attachment mechanism is positioned on the body at a second distance from the second end, with the first distance being greater than the second distance.

BRIEF DESCRIPTION OF THE DRAWINGS

FIG. 5C is a rear plan view of a conventional connector.

FIG. 5D is a rear plan view of the connector of FIG. 3.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices, components, mechanisms and methods are omitted so as to not obscure the description of the present invention with unnecessary detail.

Figure 1:
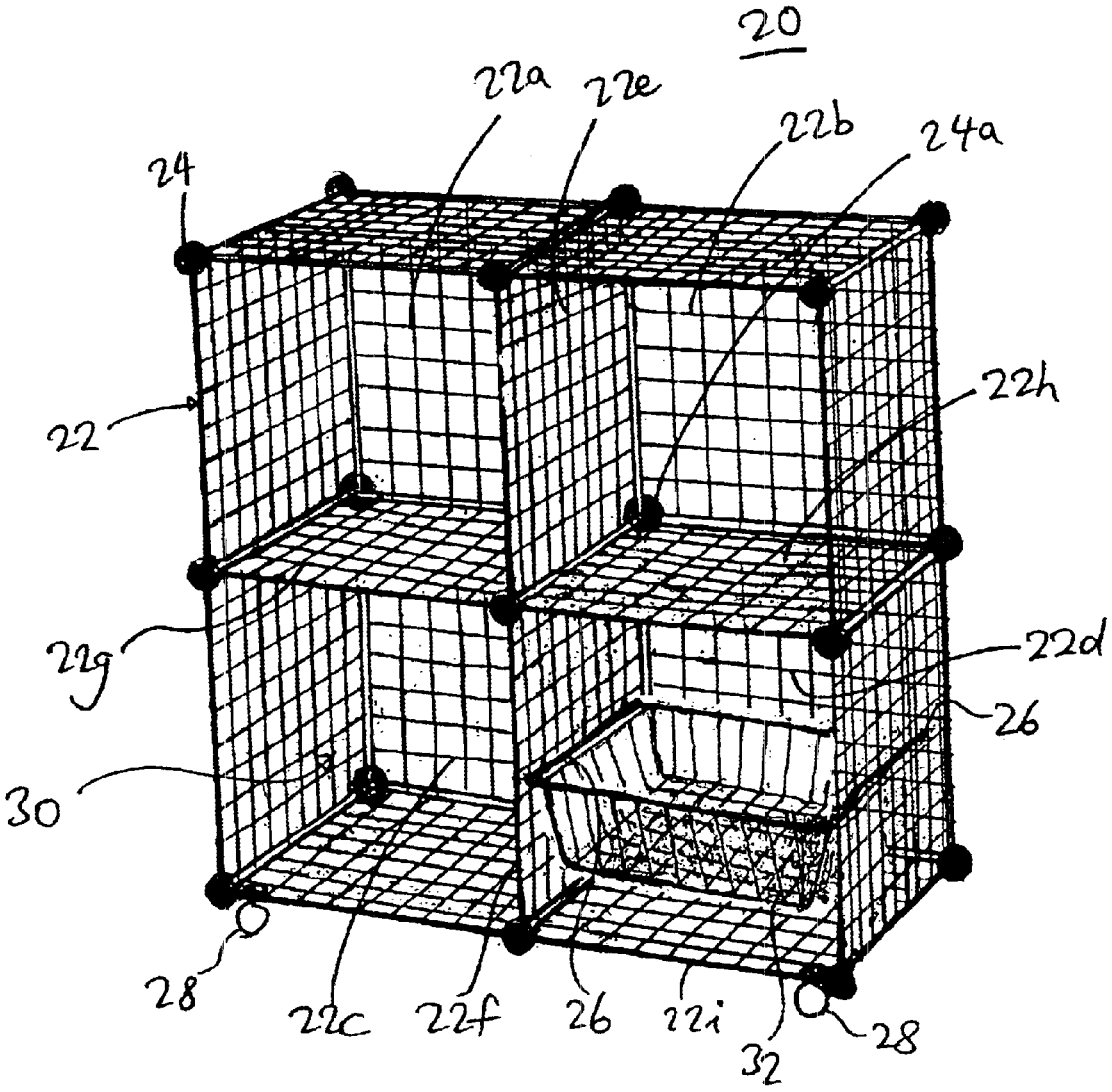
FIG. 1 is a perspective view of the storage assembly of the present invention.

The present invention provides a portable storage assembly 20. Referring first to FIG. 1, the assembly 20 is made up of four types of components: panels 22, connectors 24, tracks 26 and casters 28. These components are used to form rectangular or cubic storage units 30. Any number of each of these components can be provided, and each will be described in detail hereinbelow. These four types of components are used as the basic building blocks for assembling a portable storage assembly 20 according to the present invention. The panels 22 define the storage units 30, the connectors 24 are used to couple the panels 22 in a manner to define the storage units, opposing pairs of tracks 26 are provided in each storage unit 30, and a plurality (e.g., four) casters 28 are provided at the four base storage units 30 to support the assembly 20. A tray 32 can be inserted in any storage unit 30 along two opposing tracks 26.

Figure 2:
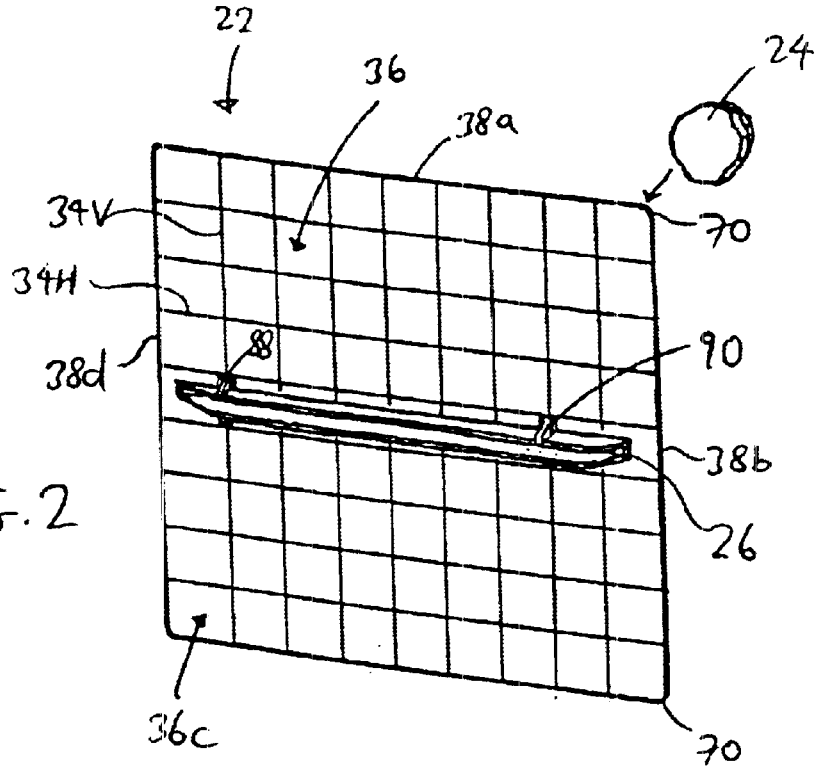
FIG. 2 is an exploded perspective view of one panel, a connector, and a track from the storage assembly of FIG. 1.
Figure 3:
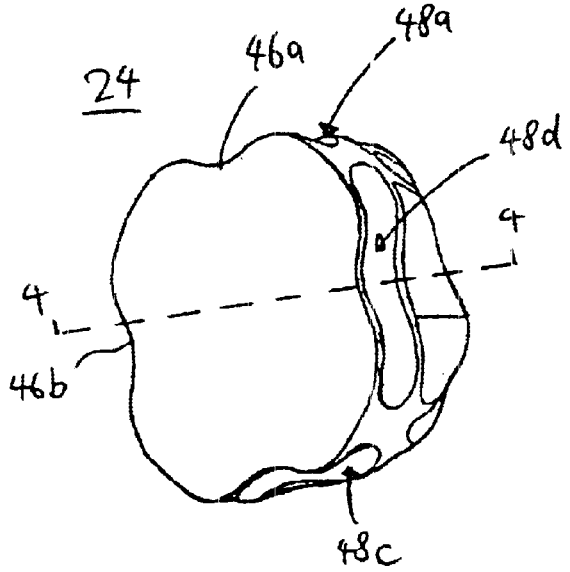
FIG. 3 is a rear perspective view of the connector of FIG. 2.
Figure 4:
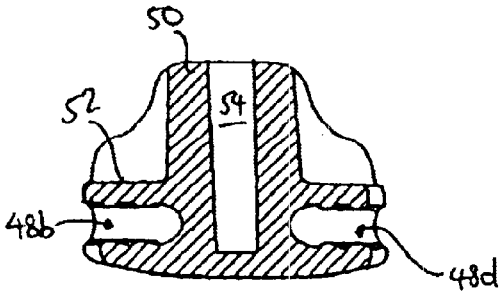
FIG. 4 is a cross-sectional plan view of the connector of FIG. 3 taken along lines 4—4 of FIG. 3.
Figure 5A:
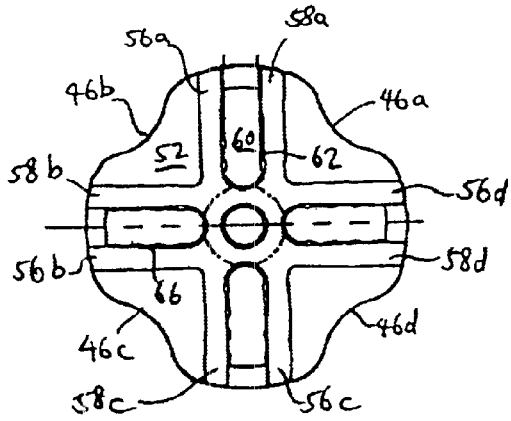
FIG. 5A is a front plan view of the connector of FIG. 3.

Referring to FIG. 2, each panel 22 can be made of a plurality of crossing horizontal metal bars 34H and vertical metal bars 34V. These crossing bars 34H and 34V create a plurality of four-sided grid openings 36. In one embodiment of the present invention, each of these grid openings 36 is preferably square in shape, and is identical, except for the corner grid opening 36*c* of each panel 22. Each grid opening 36 is preferably sized to allow for use of the resulting panel 22 or its grid openings 36 together with the connectors 24 and casters 28 described hereinbelow. The panel 22 is bordered by four border bars 38*a*, 38*b*, 38*c* and 38*d* that can have a slightly larger diameter than the crossing bars 34H and 34V. The metal bars 34V and 34H can be chrome-plated or covered with a coating of powder-coated epoxy to provide insulation against rust, and to provide any desired color. Therefore, different panels 22 can be provided in different colors to enhance the aesthetic appearance of the resulting assembly 20. In one embodiment of the present, the size of each panel 22 is preferably the same to provide for the desired modularity, although this is not necessary. In addition, the overall size of each panel 22 can be varied by increasing the number of grid openings 36, and/or by increasing the size of each grid opening 36.

Referring to FIGS. 3, 4, 5A and 5B, a connector 24 has a generally circular body 44 with four spaced-apart scalloped regions 46*a*, 46*b*, 46*c*, 46*d*. Four spaced-apart internal recesses 48*a*, 48*b*, 48*c*, 48*d* are cut from the body 44 along the circumference of the body 44 at the locations of the scalloped regions 46*a*, 46*b*, 46*c*, 46*d*. Each recess 48*a*, 48*b*, 48*c*, 48*d* defines a space that can be identical to each other, and can be spaced apart by about ninety degrees. A generally conical extension 50 extends from one surface or side 52 of the body 44, and can be provided with a bore 54 extending through the conical extension 50 and terminating at the surface 52. Four spaced-apart pairs of scallop-shaped walls 56*a* and 58*a*, 56*b* and 58*b*, 56*c* and 58*c*, and 56*d* and 58*d* also extend from the surface 52 and each pair of walls 56 and 58 defines a space 60 therebetween. The four spaced-apart pairs of walls 56*a* and 58*a*, 56*b* and 58*b*, 56*c* and 58*c*, and 56*d* and 58*d* can be positioned about ninety degrees from each other. Each space 60 can be identical with each other, and can have the same width or thickness as the space defined by each recess 48*a*, 48*b*, 48*c*, 48*d*. In addition, bumps 62 can extend from the inner surfaces 64 of each recess 48*a*, 48*b*, 48*c*, 48*d*, and from the inner surfaces 66 of each wall 56 and 58. In one embodiment, each connector 24 can have the same configuration and size. The connector 24 can be molded from plastic or cut from a metal.

Referring back to FIG. 2, a corner (such as 70) of a panel 22 can be inserted into either a recess 48 or the space 60 between a set of two walls 56, 58 of the connector 24. The bumps 62 in each of the recesses 48 or spaces 60 improve the grip of the connector 24 on the adjacent border bars 38 that define that particular corner 70, thereby minimizing the possibility that the corner 70 will become dislodged from the particular recess 48 or space 60 when the assembly 20 is deployed. As shown in FIG. 1, each connector 24 can connect up to eight separate panels 22, since each connector 24 has four spaces 60 and four recesses 48. For example, the connector 24*a* in FIG. 1 can connect four panels 22*a*, 22*b*, 22*c*, 22*d* in a single plane using its four recesses 48, and can also connect another four panels 22*e*, 22*f*, 22*g*, 22*h* in two other separate and intersecting planes. The ninety-degree spacing between the recesses 48 and spaces 60 allow for the formation of generally rectangular or cubic storage units 30 by selectively connecting certain corners 70 of selected panels 22 to selected connectors 24. Thus, the panels 70 can be quickly and conveniently connected to and removed from the connectors 24.

FIGS. 5C and 5D illustrate the advantages provided by a scalloped outline of the connector 24. Referring to FIG. 5C, a conventional connector 18 is typically circular in configuration, and would have recesses similar to recesses 48 to grip the border bars 38 of a panel 22. In contrast, as shown in FIG. 5D, the scalloped regions 46 of the connector 24 allow the body 44 of the connector 24 to be larger while (1) minimizing the area of the body 44 that intrudes into the confines of the panel 22, and (2) minimizing the material (and therefore weight) of the connector 24. The larger size of the body 44 enables each recess 48 to grip or retain a greater length of each border bar 38 that defines a corner 70 (i.e., compared shaded portions 19*a* and 19*b* in FIGS. 5C and 5D). Yet despite having a larger size, the body 44 would appear smaller because of its scalloped configuration.

Figure 6:
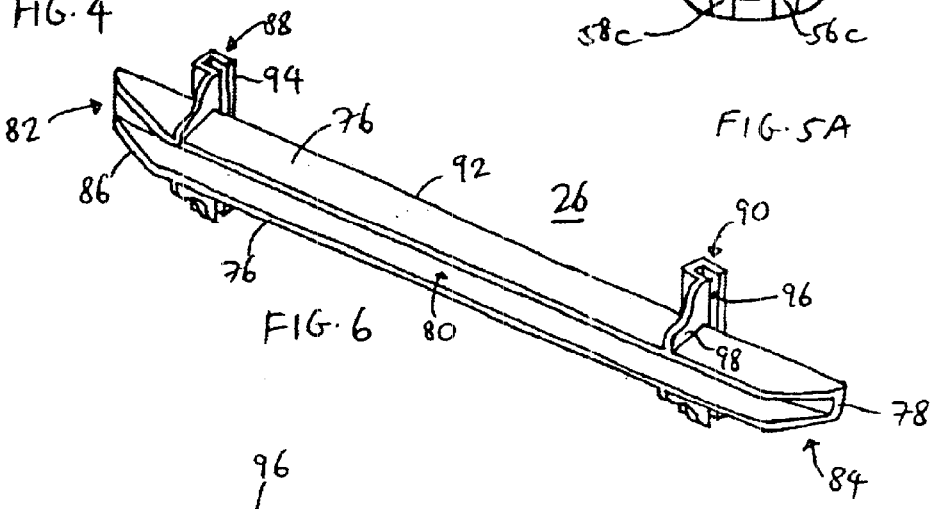
FIG. 6 is a perspective view of the track of FIG. 2.
Figure 7:
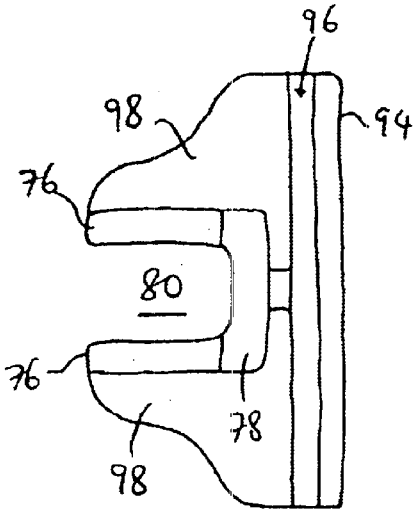
FIG. 7 is a side plan view of the track of FIG. 6.
Figure 5B:
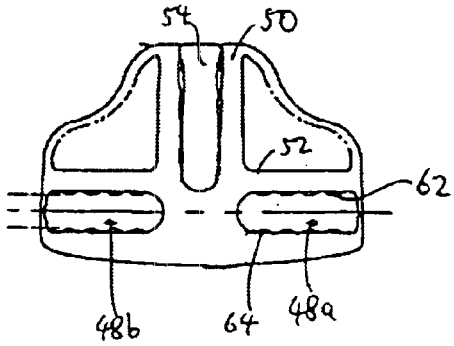
FIG. 5B is a side plan view of the connector of FIG. 3.
Figure 8:
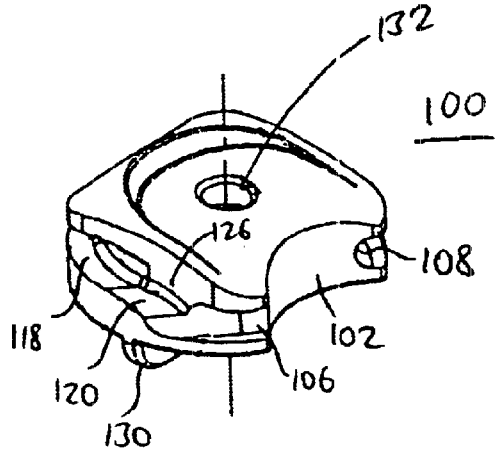
FIG. 8 is a front perspective view of the caster frame of FIG. 1.
Figure 9:
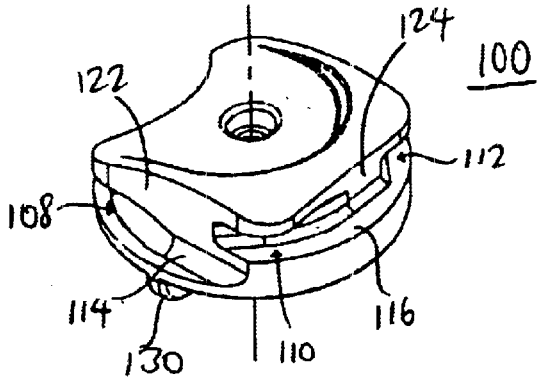
FIG. 9 is a rear perspective view of the caster frame of FIG. 8.
Figure 13:
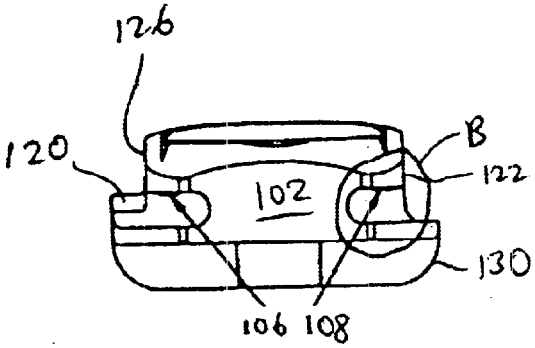
FIG. 13 is a front plan view of the caster frame of FIGS. 8 and 9.
Figure 15:
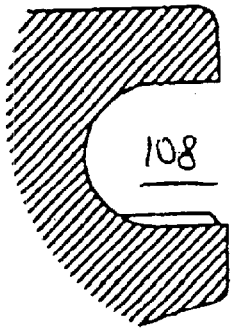
FIG. 15 is a cross-sectional view of the region B in FIG. 13.
Figure 14:
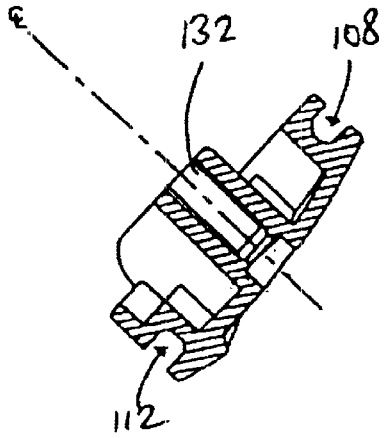
FIG. 14 is a cross-sectional plan view of the caster frame of FIGS. 8 and 9 taken along lines A—A of FIG. 10.
Figure 10:
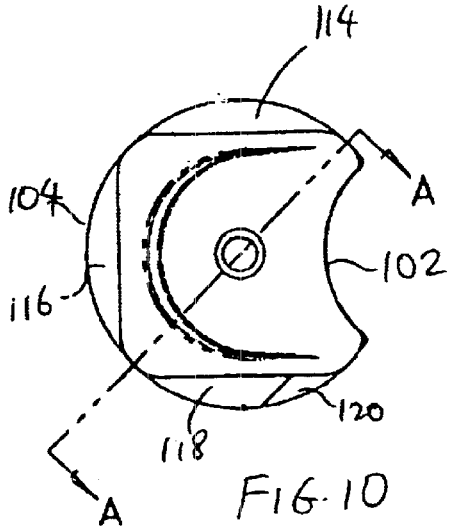
FIG. 10 is a top plan view of the caster frame of FIGS. 8 and 9.
Figure 11:
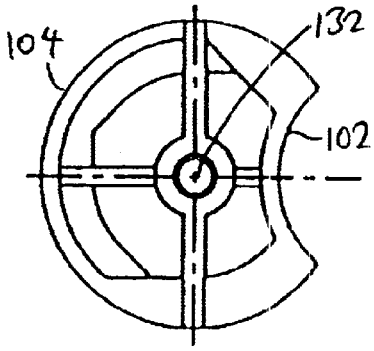
FIG. 11 is a bottom plan view of the caster frame of FIGS. 8 and 9.
Figure 12:
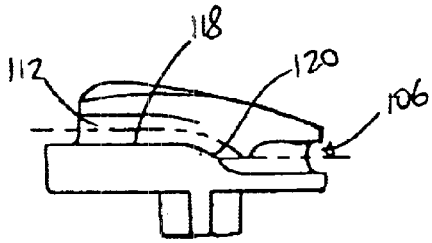
FIG. 12 is a left side plan view of the caster frame of FIGS. 8 and 9.

FIGS. 6 and 7 illustrate one track 26. Each track 26 can have the same structure, and is essentially a U-shaped body that has parallel horizontal walls 76 connected by a vertical wall 78 to define a horizontal groove 80 between the horizontal walls 76. The opposing ends 82 and 84 of the horizontal walls 76 are slanted or tapered (see 86) so as to make it easier for a user to insert an edge of a tray 32 into the groove 80. In addition, the tapering 86 will cause the tray 32 to fall off or become disengaged from the track 26 when the tray 32 is pulled out to a position where its rear edge is adjacent a tapered end 82 or 84. Otherwise, causing an end 82 or 84 of an untapered track 26 to support the entire weight of an open tray 32 may result in cracking or breakage of the track 26.

Two attachment mechanisms 88 and 90 are attached (e.g., by welding, molding or by forming the mechanisms 88, 90 in one piece with the walls 76, 78) to the outer surface 92 of the vertical wall 78 in a spaced-apart manner. Each attachment mechanism 88, 90 has a U-shaped section 94 that defines a vertical groove 96 that is oriented orthogonally to the groove 80. Support flanges 98 extend from each attachment mechanism 88, 90 and are attached to the exterior of the horizontal walls 76 to minimize warpage or bending of the U-shaped section 94 when the horizontal walls 76 are supporting the weight of a tray 32 and its contents.

Each track 26 can be quickly and conveniently coupled to the panels 22. Specifically, one or more tracks 26 are provided on opposing vertical side panels 22 that define a storage unit 30. The tracks 26 on opposing vertical side panels 22 should be aligned at the same vertical level. The coupling is accomplished by fitting each attachment mechanism 88, 90 between two horizontal bars 34H inside a separate grid opening 36 along the same row of grid openings 36 so as to maintain the same vertical level. The height of each U-shaped section 94 is dimensioned so that it is slightly smaller than (but about the same as) the size of the grid openings 36, so that the U-shaped section 94 can be fitted inside a grid opening 36 and securely retained within the vertical confines of that grid opening 36. After a U-shaped section 94 is fitted inside a grid opening 36, a vertical bar 34V of that same grid opening 36 snapped or force-fitted inside the groove 96 of the U-shaped section 94 to effectuate the connection. The two attachment mechanisms 88 and 90 are spaced-apart at a specific distance so that each U-shaped section 94 can securely grip and retain two separate and spaced-apart vertical bars 34V. Preferably, as shown in FIG. 2, the distance between the two attachment mechanisms 88, 90 is sufficiently large so that the two vertical bars 34V that are to be gripped are positioned as far apart within a panel 22. Providing the connection points (i.e., the attachment mechanisms 88, 90) further apart will distribute the load of the tray 32 along a greater length, so as to enable the track 26 to be more securely connected to the panel 22.

Figure 20:
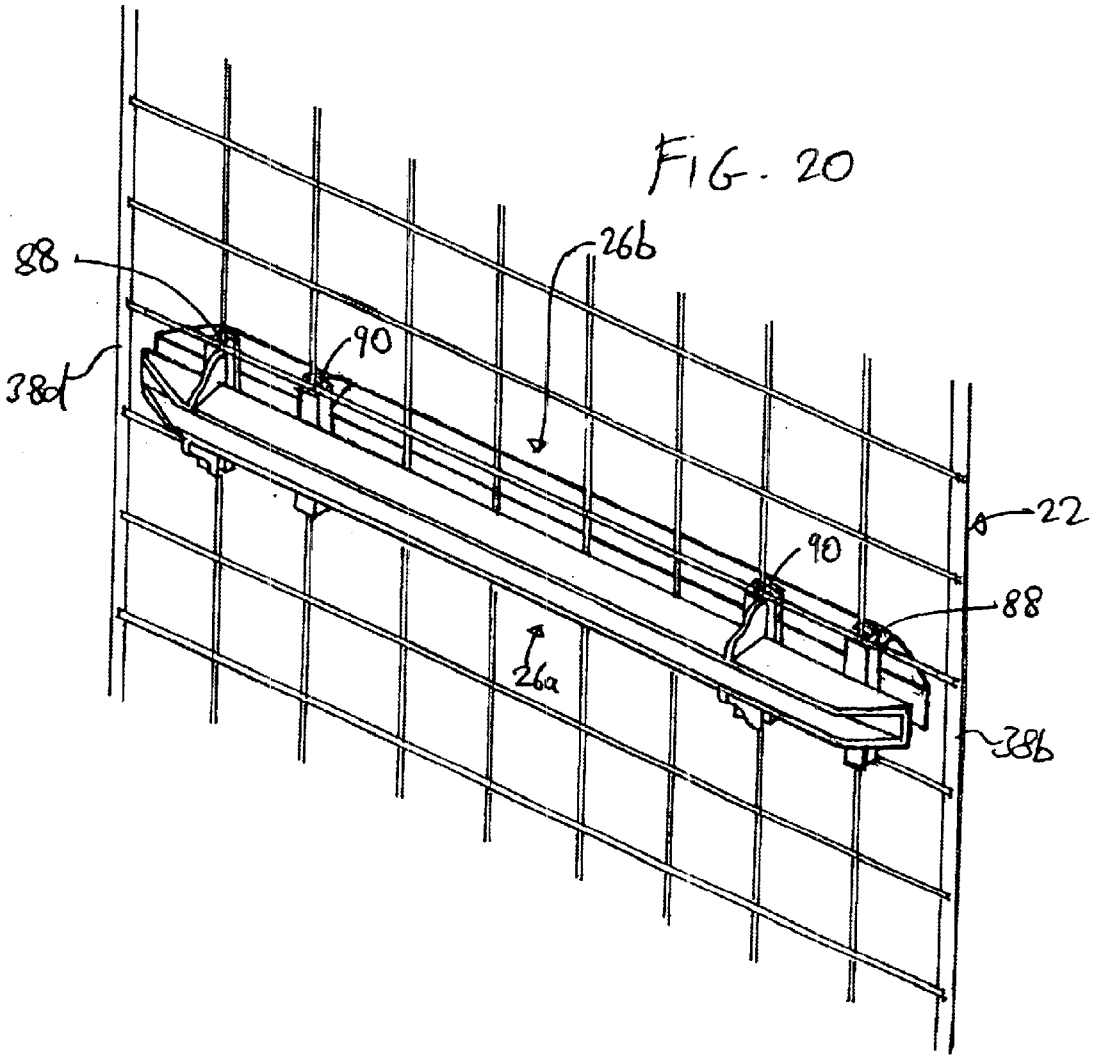
FIG. 20 illustrates how two separate tracks of FIG. 6 can be aligned at the vertical level on opposite sides of the same panel.

According to one embodiment of the present invention, the attachment mechanisms 88 and 90 can be positioned on the tracks 26 (i.e., spaced apart) in a manner that allows two separate tracks 26 to be aligned at the same vertical level on opposite sides of the same panel 22. Referring to FIGS. 2 and 20, a first track 26*a* has one attachment mechanism 88 positioned closer to one end 82 of the track 26 than the other attachment mechanism 90 is positioned closer to the other end 84. As a result, the first attachment mechanism 88 for the first track 26*a* is spaced apart from a border bar 38*d* by one grid opening 36, and the second attachment mechanism 90 for this first track 26*a* is spaced apart from an opposing border bar 38*b* by two grid openings 36. A second track 26*b* having the same structure as the first track 26*a* can be secured at the same vertical level as the first track 26*a* on the opposite side of the panel 22, since the first attachment mechanism 88 of the second track 26*b* is spaced apart from the border bar 38*b* by one grid opening 36, and the second attachment mechanism 90 of this second track 26*b* is spaced apart from an opposing border bar 38*d* by two grid openings 36. In other words, the different distances between the attachment mechanisms 88 and 90 and their respective ends 82 and 84, respectively, means that two identical tracks 26 can be reversed (i.e., with the rear of their U-shaped sections 94 facing each other) and have their respective attachment mechanisms 88 and 90 grip separate vertical bars 34V on the same panel 22.

Each pair of opposing tracks 26 positioned within a storage unit 30 can be used to slidably support the flanged side edges of a tray 32. Any number of pairs of opposing tracks 26 (and therefore any number of trays 32) can be provided for each storage unit 30 to support any corresponding number of trays 32. The trays 32 can be any conventional tray, made of metal bars or even of solid plastic, rattan bars, or woven bamboo bars, having flanged side edges that can be slid into and along the horizontal grooves 96 of the tracks 26.

FIGS. 8–15 illustrate a caster frame 100 that can be used with the caster 28. The caster frame 100 of the present invention is designed to be securely positioned within a corner grid opening 36*c* of the panel 22 so as to prevent dislodgement thereof, and operates on the basic principle of providing four separate passages, with two of the passages adapted to tightly grip two adjacent border bars 38 (e.g., 38*b* and 38*c* in FIG. 2), and with each of the other two passages adapted to retain either a horizontal bar 34H or a vertical bar 34V.

The caster frame 100 has a generally circular body having a concave front portion 102 and a convex rear portion 104. The concave front portion 102 resembles a concave wall. The caster frame 100 can be molded from plastic or cut from metal. Four passages are formed from the circumferential side edge of the circular body 100 at about ninety degrees apart from each other: a first passage 106 and a second passage 108 provided at the corners or opposing ends of the concave front portion 102, and a third passage 110 and a fourth passage 112 provided at the corners or opposing ends of the convex rear portion 104. The first and second passages 106, 108 are adapted to grip and retain two adjacent border bars 38 (e.g., 38*b* and 38*c* in FIG. 2), and each of the third and fourth passages 110, 112 is adapted to retain a horizontal bar 34H or a vertical bar 34V. The first and second passages 106, 108 are disposed at the same vertical level, while the third and fourth passages 110, 112 are disposed at a higher vertical level.

The caster frame 100 has three flanged edges that extend radially outwardly from the body 100 along a portion of the circumference thereof. A first flanged edge 114 extends at the same vertical level from the second passage 108 towards the rear portion 104. A second flanged edge 116 extends between the third and fourth passages 110, 112 along the rear portion 104 at the same vertical level as the third and fourth passages 110, 112. A third flanged edge 118 extends at the same vertical level from the fourth passage 112 towards the front portion 102 until it reaches a slope 120. This slope 120 is actually a sloping vertical wall which extends from the first passage 106, and acts as a stop surface in the manner described below. Thus, the second and third flanged edges 116 and 118 are at the same vertical level as the third and fourth passages 110, 112, and the first flanged edge 114 is at the same vertical level as the first and second passages 106, 108.

The body 100 has three vertical side walls 122, 124, 126, each vertical side wall 122, 124, 126 extending vertically from one of the flanged edges 114, 116, 118, respectively. For example, a first vertical side wall 122 is provided between the second and third passages 108, 110, and extends from the first flanged edge 114 to a vertical level that is even higher than the vertical level of the third passage 110. A second vertical side wall 124 is provided between the third and fourth passages 110, 112, and extends from the second flanged edge 116 to a vertical level that is even higher than the vertical level of the third and fourth passages 110, 112. A third vertical side wall 126 is provided between the first and fourth passages 106, 112, and extends from the third flanged edge 118 to a vertical level that is even higher than the vertical level of the third and fourth passages 110, 112. As explained below, the three vertical side walls 122, 124, 126 function to help the user align the caster frame 100 by aligning each vertical side wall 122, 124, 126 with a separate bar 34V, 34H or 38 during the installation of the caster frame 100.

The concave portion 102 is provided with a concave configuration so as to allow for unobstructed rotation of the body 100 within a corner grid opening 36*c*, as explained in greater detail below. In addition, a transverse ridge 130 extends across the bottom of the body 100 and acts as a gripping handle. A bore 132 extends through the center of the body 100, and is adapted to receive and retain a caster shaft 134 (see FIG. 19).

Figure 16:
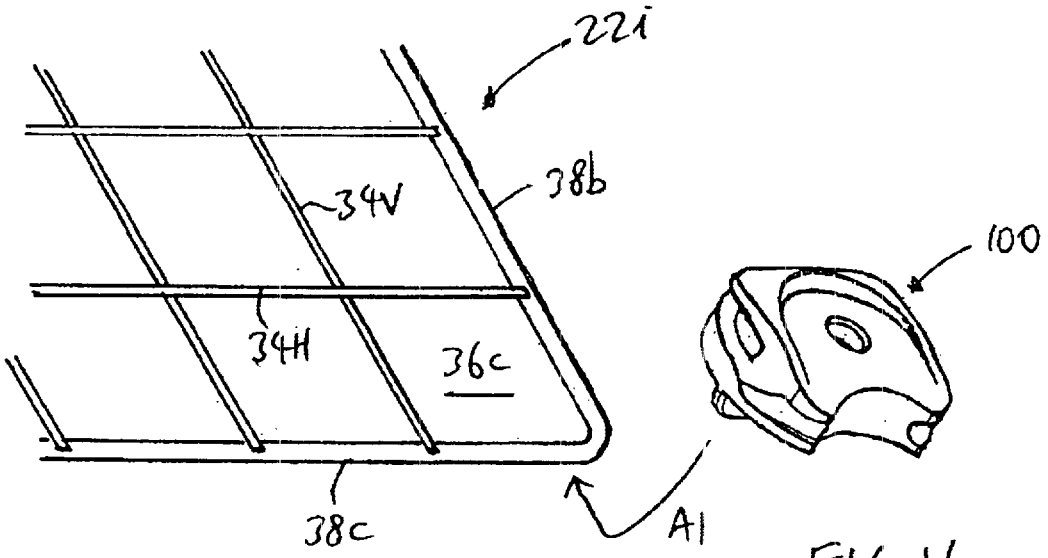
FIGS. 16–19 illustrate how the caster frame is secured to a grid opening in a panel.

FIGS. 16–19 illustrate how the caster 28 and its frame 100 are installed on a bottom panel, such as 22*i* in FIG. 1. As shown in FIG. 16, each panel 22 has a top side and a bottom side, with the top side characterized by the bars 34H and 34V being attached on top or over the border bars 38, and the bottom side being the opposite side. Each caster frame 100 is inserted through a corner grid opening 36*c* from the bottom side of the panel 22, as indicated by arrow Al in FIG. 16. In addition, each caster frame 100 is inserted in a manner such that the second and third flange edges 116 and 118 are positioned against the vertical and horizontal bars 34V and 34H, respectively, for that corner grid opening 36*c*, and the first flange edge 114 is positioned against a border bar 38 (in FIG. 17, it is 38*b*). When the caster frame 100 is positioned inside the corner grid opening 36C (see FIG. 17), the horizontal and vertical bars 34H and 34V are adjacent the second and third vertical side walls 124 and 126, respectively, and the border bar 38*b* is adjacent the first vertical side wall 122.

Figure 17:
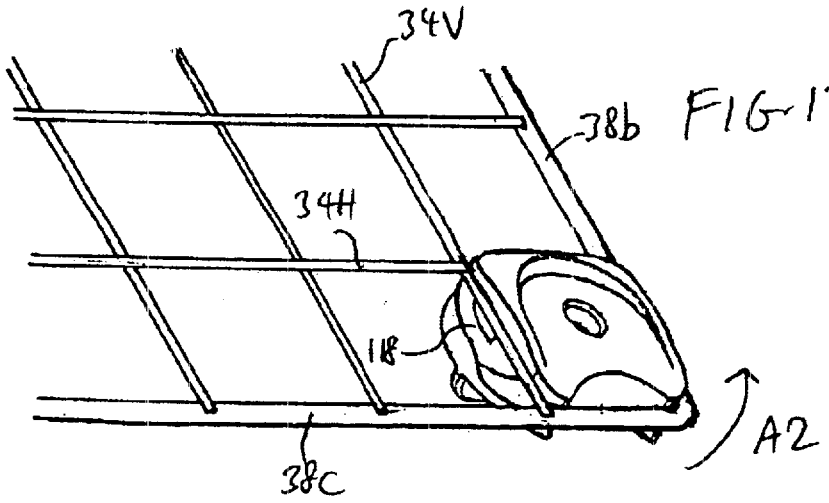

At this time, the caster frame 100 is rotated about 45 degrees counterclockwise in the direction of arrow A2 in FIG. 17. This causes the border bar 38*c* to be slid into the first passage 106 and securely retained therein, and the border bar 38*c* to be slid into the second passage 108 and securely retained therein (see FIG. 18). Thus, the first and second passages 106 and 108 can be dimensioned so that the border bars 38*c* and 38*b* are securely held inside the first and second passages 106 and 108, respectively, by a friction fit. When in the position shown in FIG. 18, the third and fourth passages 110 and 112 can be dimensioned so that the horizontal and vertical bars 34H and 34V, respectively, are loosely positioned inside the third and fourth passages 110 and 112, respectively. Up to two stop surfaces operate to limit rotation of the caster frame 100 in the counterclockwise direction. One such stop surface is the slope 120, which abuts against the border bar 38*c* to prevent further rotation of the caster frame 100. The other such stop surface is the vertical side wall 122, whose end abuts against the horizontal bar 34H when in the position shown in FIG. 18. These two stop surfaces are therefore opposite to each other, and abut against opposite bars 38*c* and 34H.

Figure 18:
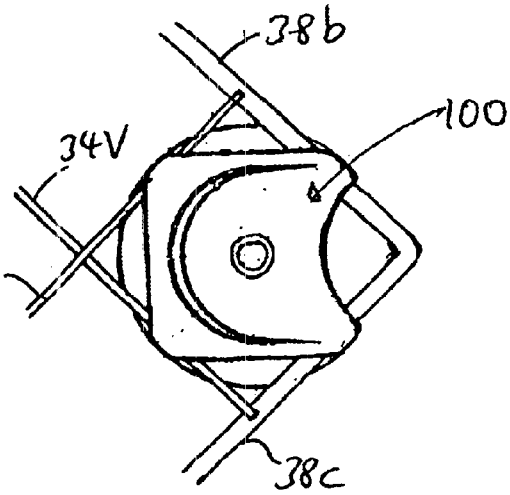

To remove the caster frame 100, the user merely rotates the caster frame 100 clockwise by 45 degrees from the position shown in FIG. 18 back to the position shown in FIG. 17.

The caster frame 100 is configured so that clockwise rotation from the position shown in FIG. 17 is not possible. This is accomplished by providing the first and second passages 106, 108 at different vertical levels from the third and fourth passages 110, 112. These different vertical levels are dimensioned to correspond to the difference in the levels between the border bars 38*b*, 38*c* and the horizontal and vertical bars 34H, 34V. For example, if the caster frame 100 were rotated clockwise from the position shown in FIG. 17, the first passage 106 cannot receive the vertical bar 34V because the vertical bar 34V is at a higher vertical level than the first passage 106, thereby causing the vertical bar 34V to abut the third vertical side wall 126. A similar effect occurs at the opposite side, where the third passage 110 cannot receive the border bar 38*b* because the border bar 38*b* is at a lower vertical level than the third passage 110, thereby causing the border bar 38*b* to abut the first vertical side wall 122.

Thus, the manner in which the stop surfaces 120, 122 and 126 limit clockwise or counterclockwise rotation of the caster frame 100, and the friction fit securement of the border bars 38*c* and 38*b* inside the first and second passages 106, 108, together ensure a secure installation of the caster frame 100 to the panel 22*i*, and essentially prevents the caster frame 100 from being dislodged from the panel 22*i*.

Figure 19:
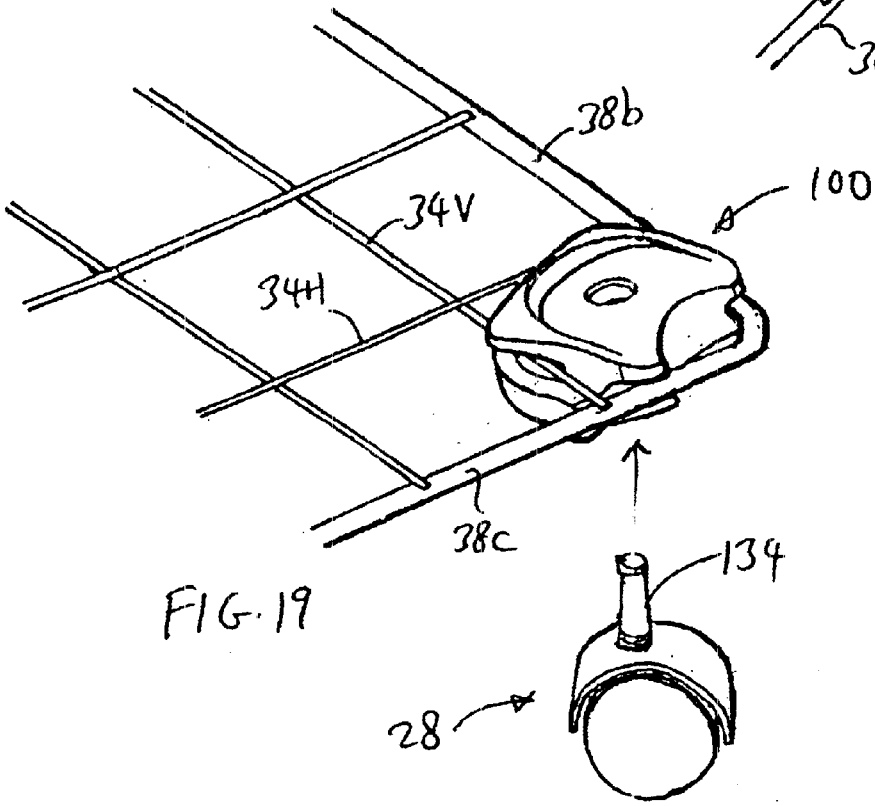

Referring now to FIG. 19, with the caster frame 100 secured to the panel 22*i*, the caster 28 can be installed on to the caster frame 100. The shaft 134 is inserted through the bore 132. The bore 132 can be configured such that its diameter at the top is less than its diameter at the bottom. Therefore, the shaft 134 can be secured inside the bore 132 by virtue of the friction or snap fit of the top of the shaft 134 with the top of the bore 132. The caster 28 can be any conventional caster.

Thus, the storage assembly 20 of the present invention provides strength and stability, which it derives from the construction of the connectors 24 which securely connects adjacent panels 22, and the construction of the caster frame 100, which allows the caster frame 100 to be securely positioned on a bottom panel 22*i* to prevent dislodgment therefrom. The connectors 24, tracks 26 and caster frames 100 are all easy to use and can be installed quickly using minimal force.

Figure 21:
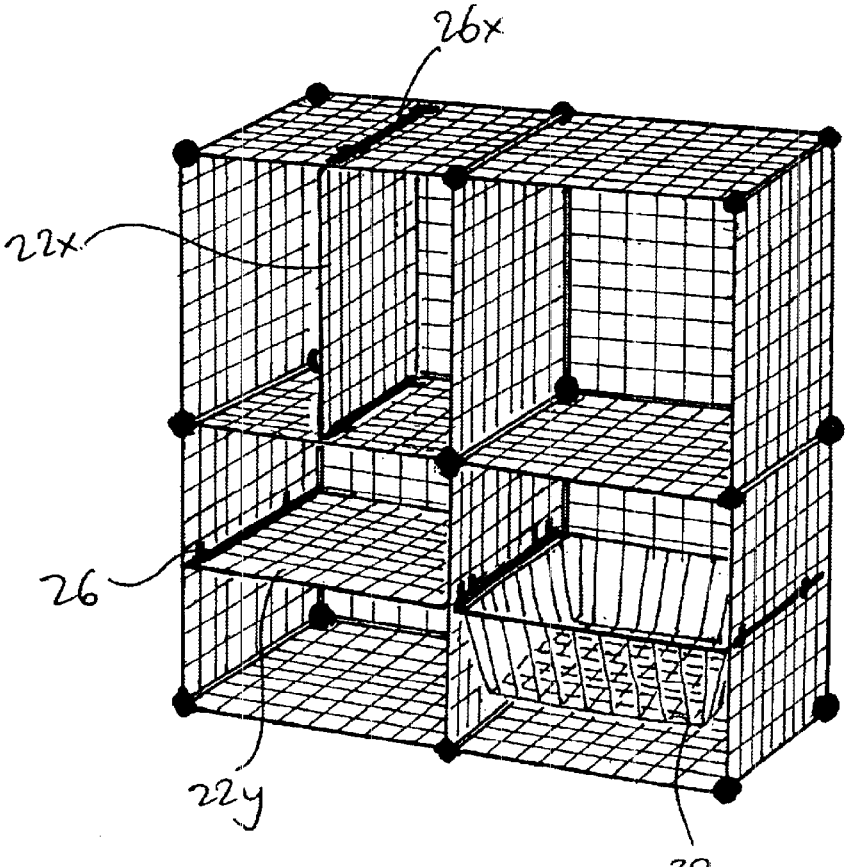
FIG. 21 illustrates different ways of positioning the panels of FIG. 2.

Those skilled in the art will appreciate that the embodiments and alternatives described above are non-limiting examples only, and that certain modifications can be made without departing from the spirit and scope thereof. The accompanying claims are intended to cover such modifications as would fall within the true scope and spirit of the present invention. As a non-limiting example, as illustrated in FIG. 21, panels 22*x* can be positioned vertically within each storage unit 30 by securing tracks 26*x* to horizontally-positioned panels 22. In addition, instead of trays 32, panels 22*y* can be positioned horizontally between tracks 26 within each storage unit 30.

What is claimed is:

1. In combination:

a panel having a plurality of crossing bars that define a plurality of grids, and a plurality of border bars; and a connector having a body that defines an outer edge along its circumference, the body having a plurality of alternating concave and convex regions that are formed along the outer edge, and a recess provided in the outer edge at each concave region;

wherein one of the border bars is retained inside one of the recesses.

2. The combination of claim 1, wherein the connector has four recesses, each recess provided in each of the concave regions, with the recesses spaced-apart by about ninety degrees.

3. The combination of claim 1, wherein the connector further includes at least one set of two spaced-apart walls extending from the body, with the two spaced-apart walls defining a space.

4. The combination of claim 3, wherein the at least one set of two spaced-apart walls comprises four sets of two spaced-apart walls, with each set of two spaced-apart walls being oriented at about ninety degrees from each other.

5. The combination of claim 1, wherein the connector is made from a single piece.

6. The combination of claim 1, wherein the body is generally circular.

7. The combination of claim 1, wherein the body has a first planar surface and a second generally planar surface that is parallel to the first surface, with the outer edge extending between the first and second surfaces.

8. The combination of claim 7, wherein each recess is cut from the body between the first and second surfaces.

9. The combination of claim 7, further including an extension that extends from the second surface, with a bore extending through the extension.

10. In combination:

a panel having a plurality of crossing bars that define a plurality of grids, and a plurality of border bars; and a connector having a body that defines an outer edge along its circumference, a first planar surface and a second generally planar surface that is parallel to the first surface, with the outer edge extending between the first and second surfaces, the body having a plurality of spaced-apart concave regions that formed along the outer edge, and with a recess extending inwardly from each concave region and between the first and second surfaces;

wherein one of the border bars is retained inside one of the recesses.

11. The combination of claim 10, wherein the connector has four recesses, each recess provided in each of the concave regions, with the recesses spaced-apart by about ninety degrees.

12. The combination of claim 11, wherein the connector further includes at least one set of two spaced-apart walls extending from the body, with the two spaced-apart walls defining a space.

13. The combination of claim 12, wherein the at least one set of two spaced-apart walls comprises four sets of two spaced-apart walls, with each set of two spaced-apart walls being oriented at about ninety degrees from each other.

14. The combination of claim 10, wherein the connector is made from a single piece.

15. The combination of claim 10, wherein the body is generally circular.

16. The combination of claim 10, further including an extension that extends from the second surface, with a bore extending through the extension.

* * * * *